US005324215A

United States Patent [19]

Walkup et al.

[11] Patent Number: 5,324,215

[45] Date of Patent: Jun. 28, 1994

[54] DUAL BEAM ELECTRICAL CONTACT

[75] Inventors: William B. Walkup, Inkstor, Mich.; Joseph S. Cachina, Bridgeport, Conn.

[73] Assignee: Burndy Corporation, Norwalk, Conn.

[21] Appl. No.: 49,146

[22] Filed: Apr. 19, 1993

[51] Int. Cl.[5] ..... H01R 13/11

[52] U.S. Cl. ..... 439/857

[58] Field of Search ..... 449/856–858, 449/860, 861, 885

[56] References Cited

U.S. PATENT DOCUMENTS

| | | | |
|---|---|---|---|
| 3,823,392 | 7/1974 | Pfiefer | 339/259 R |
| 4,288,141 | 9/1981 | Leather | 339/97 R |
| 4,317,609 | 3/1982 | Lapraik | 339/221 R |
| 4,591,230 | 5/1986 | Roldan | 339/258 R |
| 4,795,379 | 1/1989 | Sasaki et al. | 439/856 |
| 4,850,904 | 7/1989 | Shimizu | 439/856 |
| 4,932,906 | 6/1990 | Kaley et al. | 439/857 |
| 5,004,426 | 4/1991 | Barnett | 439/82 |

*Primary Examiner*—Joseph H. McGlynn
*Attorney, Agent, or Firm*—Perman & Green

[57] ABSTRACT

A dual beam electrical contact is provided with a first connection section, a middle section, and a second connection section. The first connection section has opposing substantially parallel first and second arms. Each arm has a bottom end and a cantilevered top end. The middle section connects the bottom ends of the arms to each other. The middle section has a general "S" shape with a first end of the middle section connected to the bottom end of the first arm and an opposite end of the middle section connected to the bottom end of the second arm.

11 Claims, 2 Drawing Sheets

DUAL BEAM ELECTRICAL CONTACT

BACKGROUND OF THE INVENTION

1. Field of the Invention

The present invention relates to electrical contacts and, more particularly, to a dual beam electrical contact.

2. Prior Art

U.S. Pat. No. 4,288,141 discloses an insulation displacement contact for an electrical connector with a link having a double bend that connects two arms. U.S. Pat. No. 4,317,609 discloses an electrical contact with opposing tines connected by a U-shaped section. U.S. Pat. No. 4,591,230 discloses contact members having a pair of legs that are bent from an initial parallel position into a position to partially overlap each other. U.S. Pat. No. 3,823,392 discloses a female contact blade with bent overlapped leg portions. U.S. Pat. No. 4,850,904 discloses female pin contacts with a bent portion and opposing contact pieces. U.S. Pat. No. 4,795,379 discloses a four leaf receptacle contact with a U-shaped connector and opposing arms. U.S. Pat. Nos. 5,004,426 and 4,932,906 also disclose cantilever spring arms.

SUMMARY OF THE INVENTION

In accordance with one embodiment of the present invention a dual beam electrical contact is provided comprising a first connection section, a middle section, and a second connection section. The first connection section has opposing substantially parallel first and second arms. Each of the arms has a bottom end and a cantilevered top end. The middle section connects the bottom ends of the first and second arms to each other. The middle section has a general S-shape with a first end of the middle section connected to the bottom end of the first arm and an opposite second end of the middle section connected to the bottom end of the second arm. The second connection section is connected to the middle section.

In accordance with one method of the present invention a method of manufacturing a female electrical contact having opposing dual contact beams is provided. The method comprises steps of stamping a sheet of metal to form a plurality of flat contact blanks, each blank comprising a pair of cantilevered arms connected by a middle section to a board connection section; and bending the middle sections of the blanks into a general S shape to thereby move the cantilevered arms into an opposing generally parallel relationship to each other and defining a male contact receiving area therebetween.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
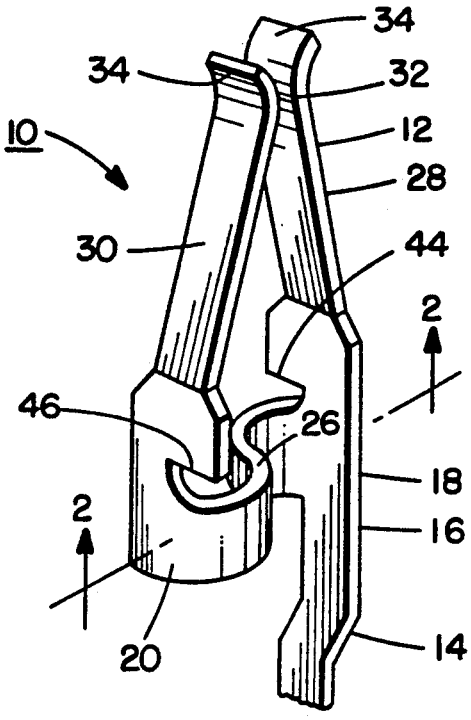
FIG. 1 is a perspective view of an electrical contact incorporating features of the present invention.

Referring to FIG. 1, there is shown a perspective view of an electrical contact 10 incorporating features of the present invention. Although the present invention will be described with reference to the single embodiment shown in the drawings, the present invention may be embodied in many alternative forms of embodiments. In addition, any suitable size, shape or type of materials or elements could be used.

The contact 10 generally comprises a first connection section 12, a second connection section 14, and a middle section 16 therebetween. The contact 10 is made of a single piece of metal that is cut and deformed to form the shape shown. The contact 10 may also include plating, such as silver or gold, at contact areas to insure good electrical contact with other contacts. The second connection section 14, in the embodiment shown, is a surface mount solder tail adapted to be positioned on a pad of a printed circuit board. However, any suitable type of second connection section could be provided. The first connection section 12 and middle section 16 are generally adapted to be inserted in a contact receiving area of an electrical connector housing (not shown) such that the second connection section 14 can extend out of a rear or bottom end of the housing.

Figure 2:
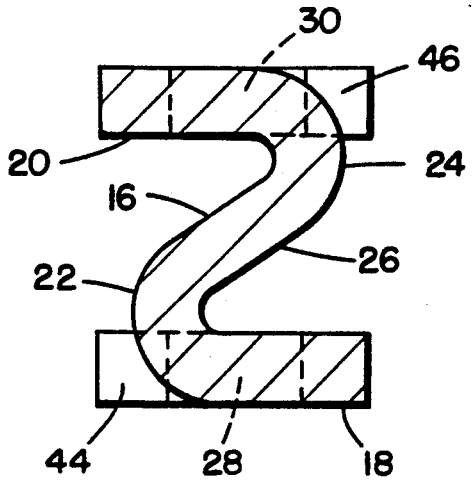
FIG. 2 is a cross-sectional view of the contact shown in FIG. 1 taken along line 2—2.

Referring also to FIG. 2, the middle section 16 has a general cross-sectional "S" or "Z" shape with a first end 18, an opposite second end 20, two bends 22, 24, and a center 26 having a general diagonal configuration. The second connection section 14 extends from the bottom of the first end 18. The first connection section 12 extends from the top of the two ends 18, 20. In the embodiment shown, the first connection section 12 comprises two cantilevered spring arms 28, 30 that are bent or canted towards each other to form a dual beam female contact. The two arms 28, 30 are located directly opposite each other and have opposing contact areas at area 32. The tips 34 of the arms 28, 30 are deformed or flared out to allow a male contact (not shown) to be more easily inserted into the area 32 between the opposing contact areas. The arms 28, 30 are adapted to deflect outward as the male contact is insert into area 32.

Figure 3:
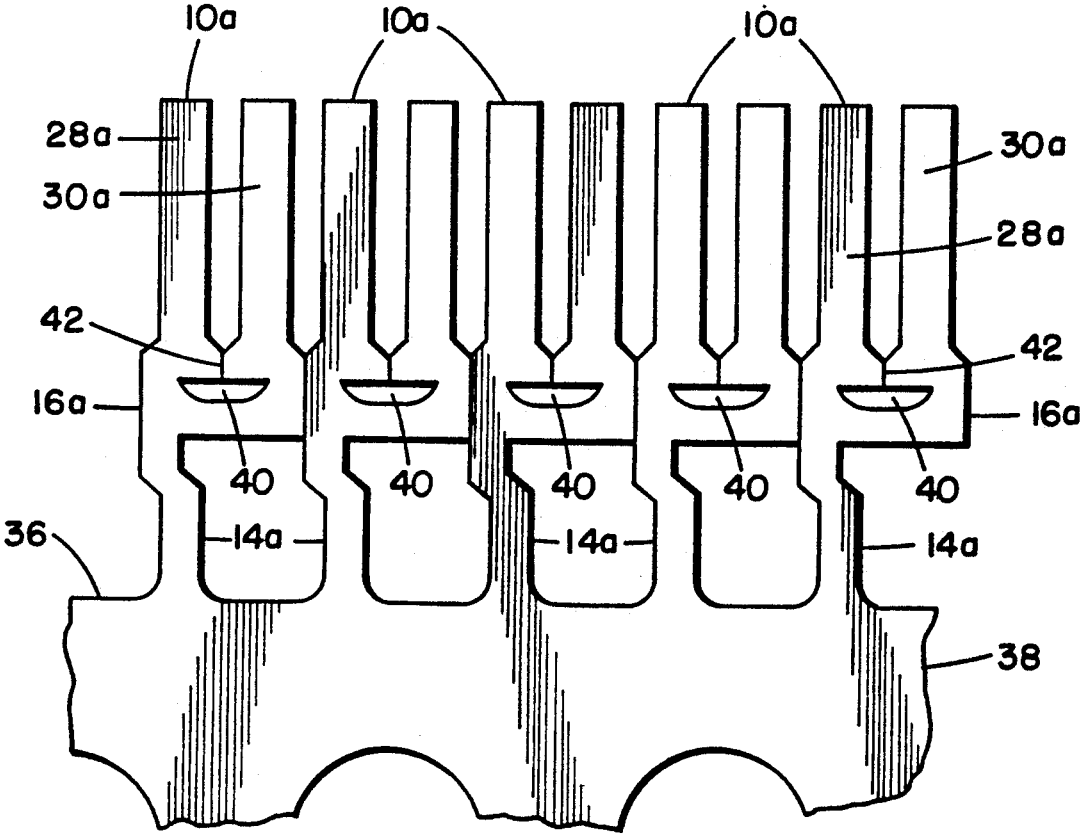
FIG. 3 is a side view of a strip of contact blanks that is used to form the contacts shown in FIG. 1.
Figure 4:
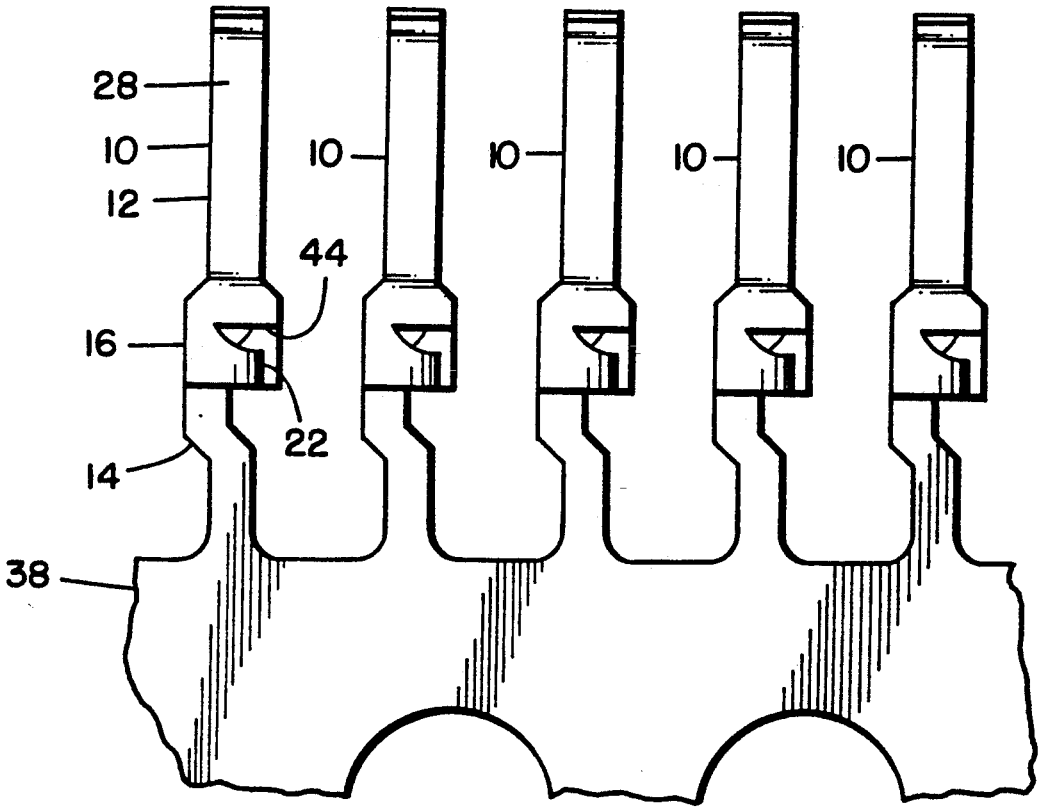
FIG. 4 is a side view of the strip shown in FIG. 3 after the contacts are formed.

Referring now also to FIGS. 3 and 4, a method of forming the contact 10 will now be described. FIG. 3 shows a side view of a strip 36 of metal that has been stamped or cut to form a carry strip 38 with a plurality of flat contact blanks 10*a* extending from one side of the carry strip 38. The blanks 10*a* are attached to the carry strip 38 by means sections 16*a* each have a center cut-out section 40 and a cut 42 that extends through the middle sections 16*a* from an area between the two arms 28*a*, 30*a* to the cut-out section 40. The center cut-out sections 40, in the embodiment shown, have a bowl-like profile. However, other shapes could be provided. The ends of the cut-out section 40 extend under the arms 28*a*, 30*a* to below approximately the center axes of the arms 28*a*, 30*a* or slightly past the center axes.

FIG. 4 shows the next step in the method. The blanks 10*a* shown in FIG. 3 are bent at the center sections 16*a* from their flat shape to the cross-sectional "S" shape shown in FIGS. 1 and 2. To form the "S" shape the second arm 30*a* is moved from its position in line with arm 28*a* to a position generally parallel but offset from the arm 28*a*. Thus, in FIG. 4, the arms 30 cannot be seen because they are located directly behind the arms 28. The cut-out relief section 40 allows the middle section 14 to be more easily deformed into its "S" shape. In addition, two ledges 44 and 46 (see FIGS. 1 and 2) are formed that are adapted to interact with the electrical connector housing (not shown) to function as a retaining means for fixedly retaining the contacts 10 in the housing. The strip of contacts 10 shown in FIG. 4 can be inserted into the connector housing (not shown) and the carry strip 38 removed.

One of the advantage of the present invention is that the contacts 10 can be stamped or formed on a relatively very tight or small pitch on the carry strip 38. The beams or arms 28, 30 are preferably uniform and separately retained by their ledges 44, 46 in the connector housing. For uniform arms 28, 30 and a uniform "S" shaped middle section 16, the contacts 10 would be able to align themselves in the contact receiving areas of the connector housing when they are inserted. In an alternate method, rather than merely moving the arm 30*a*, both arms 28*a* and 30*a* could be moved relative to the carry strip 38 if desired; the second connection section 14*a* being deformed in the process. The present invention also utilizes stock material more efficiently in forming the contacts 10. Efficiencies in plating, assembly time, and complexity of assembly equipment could also be favorably impacted.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A dual beam electrical contact comprising:

a first connection section having directly opposing substantially parallel first and second arms, each of the arms having a bottom end and a cantilevered top end;

a middle section connecting the bottom ends of the first and second arms to each other, the middle section having a general "S" shape with a first end of the middle section connected to the bottom end of the first arm and an opposite second end of the middle section connected to the bottom end of the second arm; and a second connection section connected to the middle section.

2. A contact as in claim 1 wherein the top ends of the arms each have opposing flared tips.

3. A contact as in claim 1 wherein the bottom ends of the arms each comprise means for mounting the contact to an electrical connector housing.

4. A contact as in claim 1 wherein the arms are bent towards each other proximate the middle section.

5. A contact as in claim 1 wherein the second connection section comprises a solder tail.

6. A contact as in claim 1 wherein the general "S" shape is generally transverse to elongate axes of the arms.

7. A method of manufacturing a female electrical contact having opposing dual contact beams, the method comprising steps of:

stamping a sheet of metal to form a plurality of flat contact blanks, each blank comprising a pair of cantilevered arms connected by a middle section to a board connection section; and bending the middle sections of the blanks into a general "S" shape to thereby move the cantilevered arms into an opposing generally parallel relationship to each other and defining a male contact receiving area therebetween.

8. A method as in claim 7 wherein the step of stamping comprises cutting the sheet of metal to form adjacent side-by-side middle sections.

9. A method as in claim 7 wherein the step of stamping comprises cutting a relief section from the middle sections to allow the middle sections to be bent more easily.

10. A method as in claim 7 wherein the steps of stamping comprises the sheet of metal forming a carry strip with the blanks being attached to the carry strip by their board connection sections.

11. A method as in claim 7 wherein the step of bending includes canting the arms towards each other.

* * * * *